US006719284B2

(12) United States Patent
Hsiao et al.

(10) Patent No.: US 6,719,284 B2
(45) Date of Patent: Apr. 13, 2004

(54) DOCUMENT FEEDING APPARATUS

(75) Inventors: Sidney Hsiao, Changhua (TW); Julian Liu, Taipei (TW); Jackly Liu, Taichung (TW); Clark Huang, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 11 days.

(21) Appl. No.: 10/191,537

(22) Filed: Jul. 10, 2002

(65) Prior Publication Data

US 2003/0090052 A1 May 15, 2003

(30) Foreign Application Priority Data

Nov. 15, 2001 (TW) ..... 90219699 U

(51) Int. Cl.[7] ..... B65H 3/06

(52) U.S. Cl. ..... 271/116; 271/114; 271/10.13; 192/41 S; 192/81 C

(58) Field of Search ..... 271/114, 116, 271/10.13; 192/41 S, 81 C

(56) References Cited

U.S. PATENT DOCUMENTS 4,844,638 A * 7/1989 Kagami et al. ..... 400/636
5,116,038 A * 5/1992 Kim ..... 271/10.11
5,630,580 A * 5/1997 Tsao et al. ..... 271/10.13

* cited by examiner

*Primary Examiner*—Donald P. Walsh
*Assistant Examiner*—Matthew J. Kohner
(74) *Attorney, Agent, or Firm*—Rosenberg, Klein & Lee

(57) ABSTRACT

A document feeding apparatus is used in an office machine in the present invention. The document feeding apparatus includes an intermittent gear set, a first roller, a second roller, and a driving device. The intermittent gear set includes a gear, a shaft, a one-way spring clutch, an arcuate groove, and a pin. The intermittent gear set selectively drives the first roller to rotate so that the first roller conveys the document selectively. The present invention keeps in separation of the document from a next feed-in document and prevents the documents from overlapping.

7 Claims, 7 Drawing Sheets

DOCUMENT FEEDING APPARATUS

FIELD OF THE INVENTION

The present invention relates to a document feeding apparatus used in an office machine, and more specifically relates to a document feeding apparatus having simple mechanism and separating a feed-in document from a next feed-in document within a fixed distance.

BACKGROUND OF THE INVENTION

Generally, a document feeding apparatus is used in an office machine, such as a fax machine, a scanner, a printer, a copy machine, or a multi-function peripheral (MFP), to convey the document into the office machine. No matter the document feeding apparatus is applied to which kind of office machine, the document feeding apparatus should convey the documents one by one and prevent the documents from overlapping with each other. Moreover, when the document feeding apparatus conveys a document, the document should proceed straightforward so as to get a better quality.

Due to the automatic document feeder (ADF) applying to the multi-function peripheral, the ADF is better to avoid the complex design and high cost in manufacturing. Conventionally, to avoid any documents overlapping, the conventional ADF typically uses a separation roller (not shown) to separate documents. However, the conventional ADF still has a disadvantage in easily causing the double feed and/or jam due to the insufficient separation of documents.

SUMMARY OF THE INVENTION

Accordingly, an object of the present invention is to provide an automatic document feeding apparatus that is used in an office machine, such as a fax machine, a scanner, a printer, a copy machine, or a multi-function peripheral (MFP).

Another object of the present invention is to provide an automatic document feeding apparatus that conveys documents one by one without concerns of overlapping feeding of documents.

The present invention includes an intermittent gear set, a first roller, a second roller, and a driving device. The intermittent gear set includes a gear, a shaft, a one-way spring clutch, an arcuate groove, and a pin. The driving device provides the gear and the second roller a power to rotate. The intermittent gear set selectively drives the first roller to pick up the document. The pin is selectively movable in the arcuate groove so that the first roller selectively picks up the document resulting in separation of a document from next feed-in document to prevent a document from papers jamming.

Other features, benefits and advantages of the invention will be apparent from the following detailed description of preferred embodiments taken in conjunction with the accompanying drawing figures.

BRIEF DESCRIPTION OF THE DRAWINGS

FIG. 1(*b*) is a side view showing the intermittent gear set of the first embodiment;

DETAIL DESCRIPTION OF PREFERRED EXEMPLARY EMBODIMENT

The present invention discloses a document feeding apparatus for separating the feed-in papers and preventing the feed-in papers from overlapping or jamming.

Figure 1A:
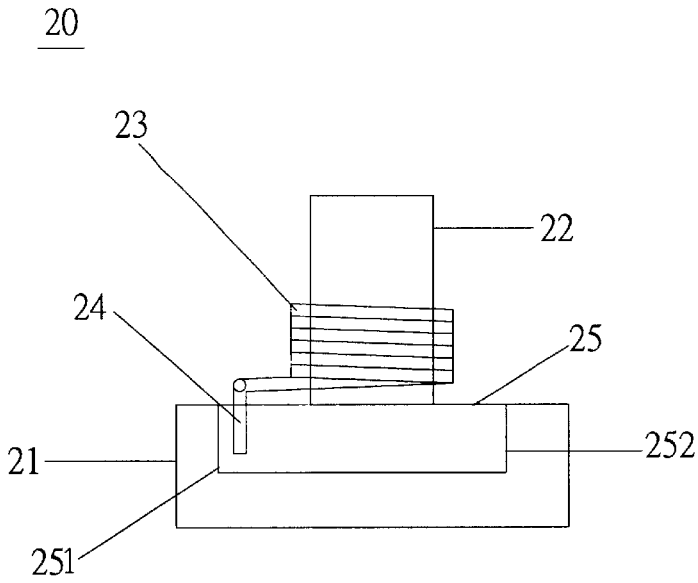
FIG. 1(*a*) is an elevation view showing the intermittent gear set of the first embodiment.
Figure 1B:
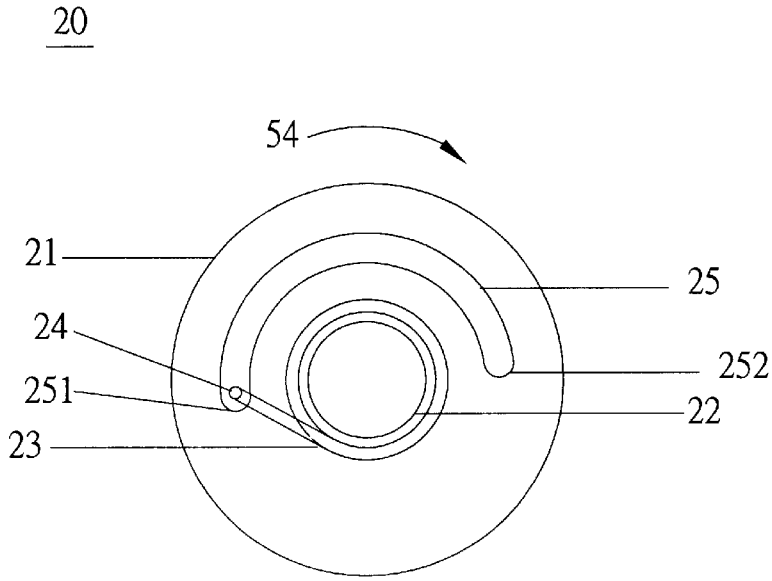
Figure 2:
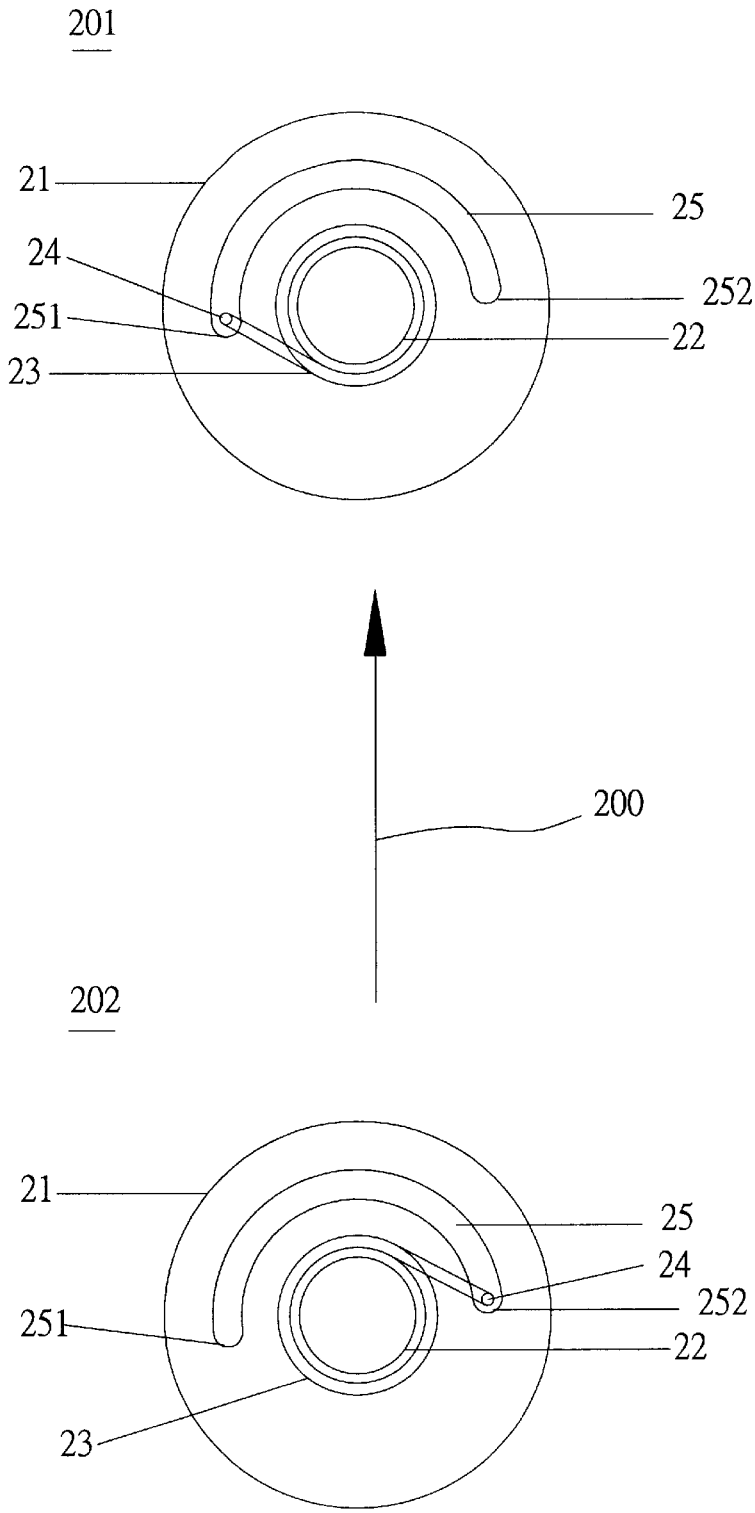
FIG. 2 is a side view showing the intermittent gear set operating in the two states.

The first embodiment of the present invention, as shown in FIGS. 1(*a*) and 1(*b*), includes an intermittent gear set 20. The intermittent gear set 20 has a gear 21, a shaft 22, a one-way spring clutch 23, a pin 24, and an arcuate groove 25. The gear 21 is connected to the one-way spring clutch 23. The gear 21 and the one-way spring clutch 23 respectively fixed to and rotatable with the shaft 22. The gear 21 rotates selectively in a first direction 54 and drives the one-way spring clutch 23 to rotate so that the one-way spring clutch 23 is fixed to and drives the shaft 22 to rotate. The arcuate groove 25 is located on a side of the gear 21 and defines a first end 251 and a second end 252. The pin 24 is extended from the one-way spring clutch 23, and is disposed into and selectively movable in the arcuate groove 25. When the pin 24 is at the first end 251 of the arcuate groove 25, the intermittent gear set 20 operates in a first state 201. When the pin 24 is at the second end 252 of the arcuate groove 25, the intermittent gear set 20 operates in a second state 202, as shown in FIG. 2.

Figure 3:
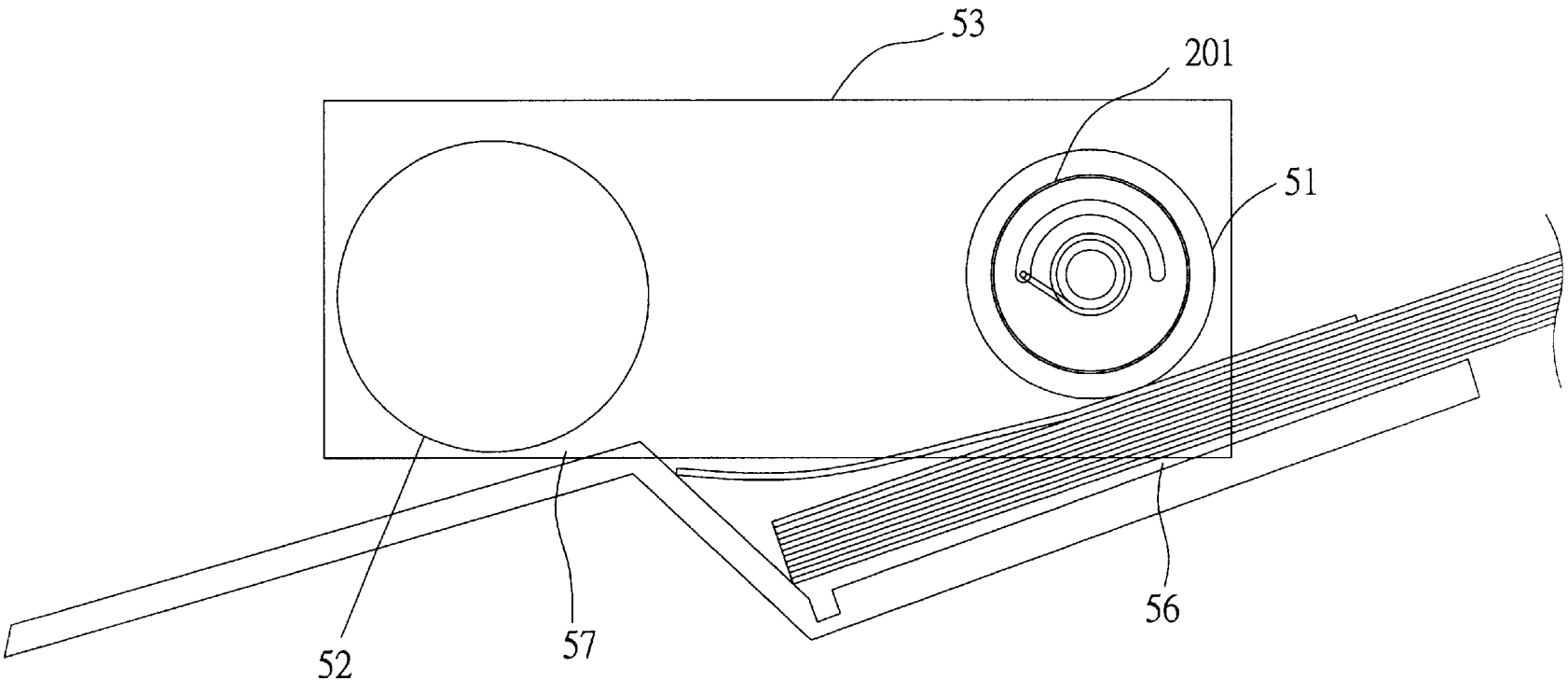
FIG. 3, FIG. 4 and FIG. 5 are side views showing the present invention during feeding process.
Figure 4:
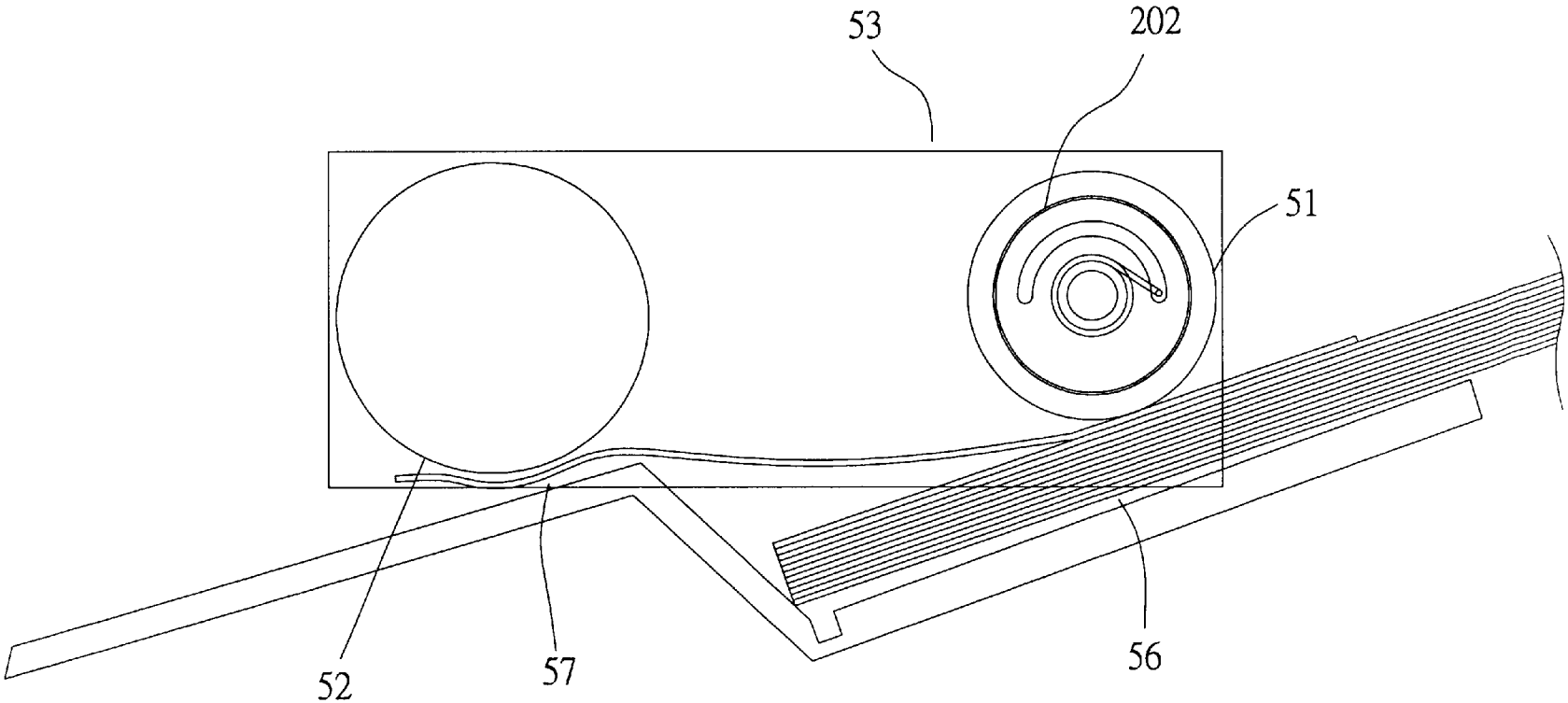

This embodiment, as shown in FIG. 3, further includes a first roller 51, a second roller 52, and a driving device 53. The first roller 51 is fixed to and rotatable with the shaft 22 to convey the document from a first position 56 to a second position 57. The second roller 52 conveys the document at the second position 57 forward, as shown in FIG. 4. The driving device 53 provides the gear 21 and the second roller 52 a power to rotate in the first direction 54. Besides, the tangent speed of the second roller 52 is faster than the tangent speed of the first roller 51.

The motion of the intermittent gear set 20 is as follows. Referring to the FIG. 3, when the intermittent gear set 20 operates in the first state 201, the pin 24 rotates to touch the first end 251 of the arcuate groove 25 so that the one-way spring clutch 23 rotates and fixes the shaft 22. Then, the shaft 22 is rotatable with the one-way spring clutch 23 to drive the first roller 51 to convey the document. Referring to the FIG. 4, because the second roller 52 and the first roller 51 convey the same document and the tangent speed of the second roller 52 is faster than the tangent speed of the first roller 51, when second roller 52 conveys the document at the second position 57, the document transfers a power from the second roller 52 to the first roller 51. On the other hand, the power of the second roller 52 is transferred to the first roller 51 to rotate with the second roller 52 so that the tangent speed of first roller 51 is changed as same as the tangent speed of the second roller 52. At the same time, the one-way spring clutch 23 is separated from the shaft 22 so that the pin 25 moves to the second end 252 of the arcuate groove 24, and the intermittent gear set 20 enters the second state 202.

Figure 5:
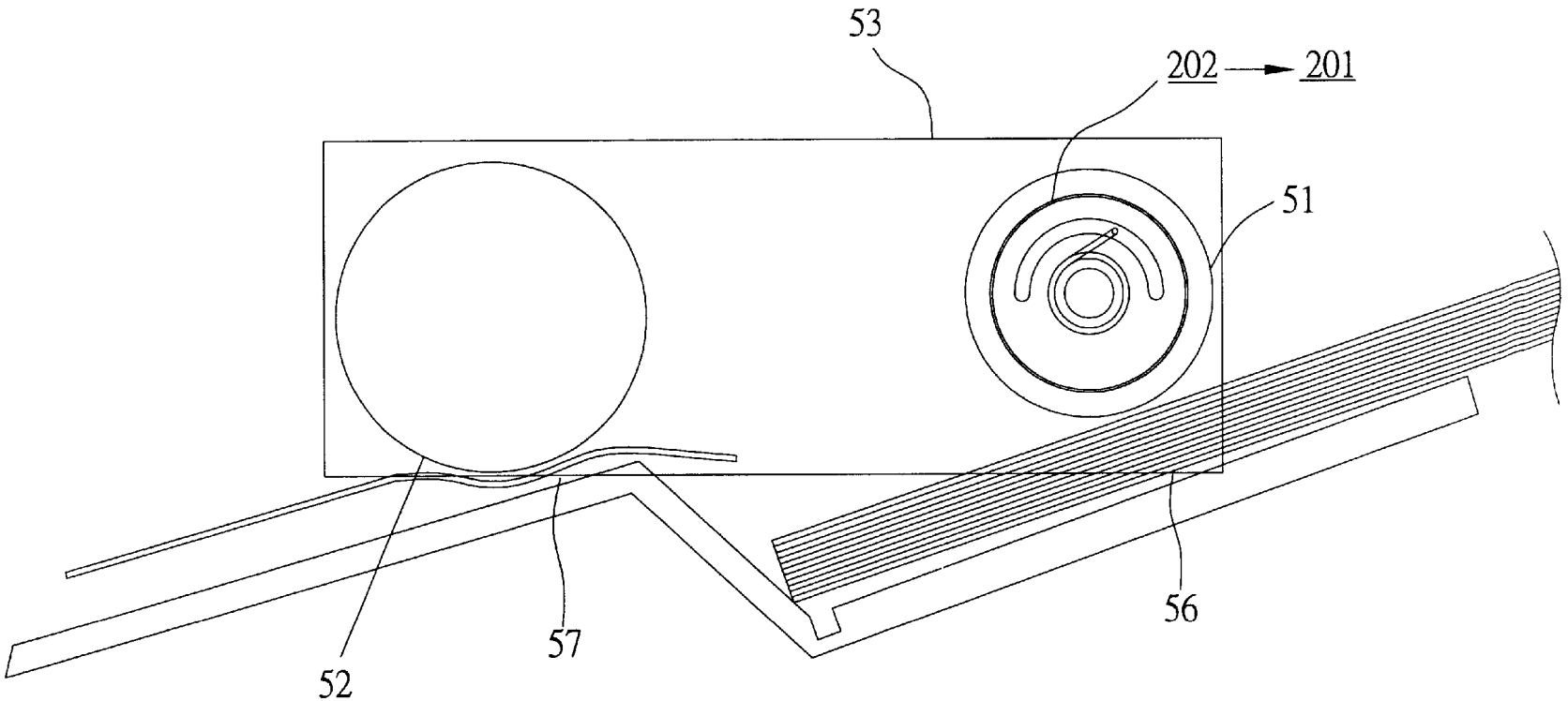

Moreover, as shown in FIG. 5, when the document leaves the first roller 51, the first roller 51 stops rotating because of losing the power. However, the second roller 51 continues rotating to convey the document such that the gear 21 drives the one-way spring clutch 23 to rotate again. Then, the pin 25 moves to the first end 251. That is, the intermittent gear set 20 enters the first state 201. Then, an intermittent time 200 which the intermittent gear set 20 changes states from the second state 202 to the first state 201 is defined. The first roller 51 stops rotating during the intermittent time 200 resulting in separation of the document from a next feed-in document. Repeating the same process, and the document feeding apparatus conveys the document one by one and prevents conveying two or more documents at the same time.

Figure 6:
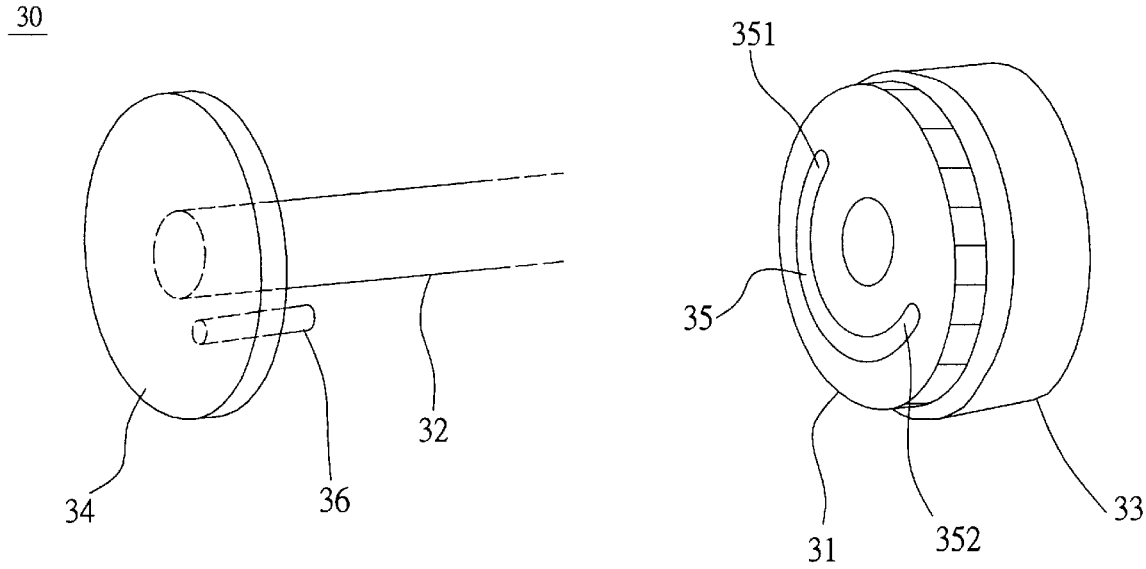
FIG. 6 is an enlarged sectional view showing the intermittent gear set of the second embodiment.

The second embodiment of the present invention uses the intermittent gear set 30 instead of the intermittent gear set 20, as shown in FIG. 6. The intermittent gear set 30 has a gear 31, a shaft 32, a one-way bearing clutch 33, a sideboard 34, at least an arcuate groove 35, and at least a pin 36. The gear 31 is connected to the one-way bearing clutch 33. The gear 31 and the one-way bearing clutch are respectively fixed to and rotatable with the shaft 32. The gear 31 rotates selectively in a first direction 54 and drives the one-way bearing clutch 33 to rotate. Then, the one-way bearing clutch 33 rotates and fixes to the shaft 32 so that the shaft 32 is rotatable selectively with the one-way bearing clutch 33. The sideboard 34 is connected pivotally to the shaft 32. The arcuate groove 35 is located on a side of the gear 31 and defined a first end 351 and a second end 352. The pin 36 is extended from the sideboard 34 and is disposed into and selectively movable in the arcuate groove 35.

Figure 7:
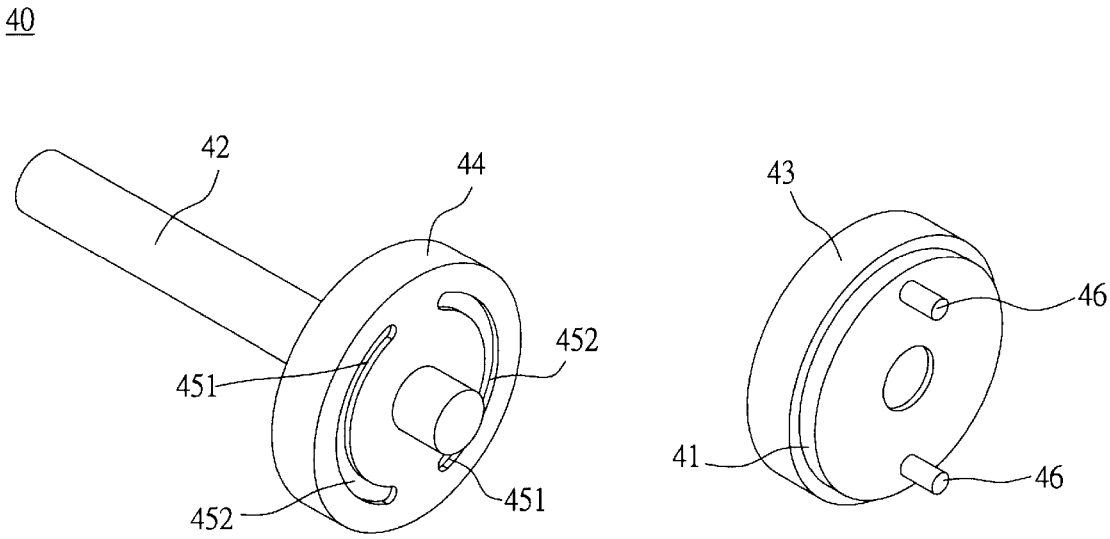
FIG. 7 is an enlarged sectional view showing the intermittent gear set of the third embodiment.

The third embodiment of the present invention uses the intermittent gear set 40 instead of the intermittent gear set 30, as shown in FIG. 7. The intermittent gear set 40 includes a gear 41, a shaft 42, a one-way bearing clutch 43, a sideboard 44, at least an arcuate groove 45, and at leas a pin 46. The gear 41 is connected to the one-way bearing clutch 43. The gear 41 and the one-way bearing clutch are respectively fixed to and rotatable with the shaft 42. The gear 41 rotates selectively in a first direction 54 and drives the one-way bearing clutch 43 to rotate. Then, the one-way bearing clutch 43 rotates and fixes to the shaft 42 so that the shaft 42 is rotatable selectively with the one-way bearing clutch 43. The sideboard 44 is connected pivotally to the shaft 42. The arcuate groove 45 is located on the gear 41 and defined a first end 451 and a second end 452. The pin 46 is extended from the one-way bearing clutch 43 and is disposed into and selectively movable in the arcuate groove 45.

The present invention not only feeds the document, but also keeps separation of the feed-in document from a next feed-in document due to the first roller 51 stopping rotating during the intermittent time 200.

While the invention has been described in connection with what is presently considered to be the most practical and preferred embodiments, it is to be understood that the invention is not to be limited to the discovered embodiments. The invention is intended to cover various modifications and equivalent arrangement included within the spirit and scope of the appended claims.

What is claimed is:

1. An intermittent gear set comprising:

a gear rotating selectively in a first direction;

a one-way clutch fixed to and selectively rotatable with said gear;

a shaft fixed to and rotatable with said one-way clutch in said first direction;

at least one arcuate groove located at a predetermined position on an operation face rotatable with said gear; and at least one pin parallel fixed with said shaft, relative to said arcuate groove and being disposed in and selectively movable in said arcuate groove;

wherein said intermittent gear set operates between a first state for said pin retaining against a first end of said arcuate groove and a second state for said pin retaining against a second, end of said arcuate groove.

2. The document feeding apparatus of claim 1, further comprising a first roller and a second roller, said first roller being fixed to and rotatable with said shaft to convey a document from a first position to a second position, said second roller conveying said document at said second position forward.

3. The document feeding apparatus of claim 2, further comprising a driving device, said driving device providing a power to drive said gear and said second roller to rotate.

4. The document feeding apparatus of claim 3, wherein motion of said intermittent gear set comprising:

when said intermittent gear set is in said first state, said one-way spring clutch is rotatable with said gear, resulting in said shaft being rotatable with said one-way spring clutch, and said first roller is rotatable with said shaft to convey said document;

when said second roller conveys said document at said second position, said document transfers said power from said second roller to said first roller, resulting in separation of said one-way spring clutch from said shaft, and said intermittent gear set operates in said second state;

when said document leaves said first roller, said first roller stops, rotating resulting in said intermittent gear set operating in said first state, and said one way spring clutch drives said shaft to rotate again to convey a next document by said first roller.

5. The document feeding apparatus of claim 4, further defined an intermittent time indicated said intermittent gear set changing states from said second state to said first state, and said first roller stops rotating during said intermittent time, resulting in a separation between said document and said next feed-in document.

6. An document feeding apparatus comprising:

an intermittent gear set including a selective rotatable gear, a one-way clutch fixed to and selectively rotatable with said gear;

a shaft fixed to and rotatable with said one-way clutch, at least one arcuate groove located at a predetermined position on an operation face rotatable with said gear, and at least one pin parallel fixed with said shaft, relative to said arcuate groove and being disposed in and selectively movable in said arcuate groove;

a first roller being fixed to and rotatable with said shaft to convey a document from a first position to a second position;

a second roller conveying said document at said second position forward; and a driving device providing a power to drive said gear and said second roller to rotate;

wherein said intermittent gear set operates between a first state and a second state, and defines an intermittent time during which the intermittent gear set changes states from the first state to the second state while the first roller stops rotating, resulting in separation of the document from the next-feed in document.

7. The document feeding apparatus of claim 6, wherein when said intermittent gear set is in said first state, said one-way clutch is rotatable with said gear, resulting in said shaft being rotatable with said one-way clutch, and said first roller is rotatable with said shaft to convey the document, wherein when said second roller conveys said document at said second position, said document transfers said power from said second roller to said first roller resulting in the separation of said one-way clutch from said shaft and said intermittent gear set operates in said second state, and wherein when said document leaves said first roller, said first roller stops rotating resulting in said intermittent gear set operating in said first state, and said one way bearing clutch drives said shaft to rotate again to convey a next document by said first roller.

* * * * *